US006814083B2

(12) United States Patent
Likness et al.

(10) Patent No.: US 6,814,083 B2
(45) Date of Patent: Nov. 9, 2004

(54) APPARATUS FOR MEASURING SMOKING TOPOGRAPHY

(75) Inventors: Mark A. Likness, Baltimore, MD (US); Robert M. Wessel, Millersville, MD (US)

(73) Assignee: Plowshare Technologies, Inc., Baltimore, MD (US)

( * ) Notice: Subject to any disclaimer, the term of this patent is extended or adjusted under 35 U.S.C. 154(b) by 0 days.

(21) Appl. No.: 10/214,325

(22) Filed: Aug. 8, 2002

(65) Prior Publication Data

US 2004/0031497 A1 Feb. 19, 2004

(51) Int. Cl.[7] ..... A24F 9/00
(52) U.S. Cl. ..... 131/330
(58) Field of Search ..... 131/178, 187, 131/329, 330; 702/45, 46; 128/204.13, 204.21, 204.22, 204.06; 73/23.3, 23.36

(56) References Cited

U.S. PATENT DOCUMENTS 5,357,971 A * 10/1994 Sheehan et al. ..... 600/532
5,819,756 A * 10/1998 Mielordt ..... 131/330

OTHER PUBLICATIONS

Company News, PlowShare Technologies, retrieved from www.plowshare.com on Jul. 8, 2003, 2 pages.*
CReSSmicro/CReSShost User Guide Revision 0.3, Published Feb. 12, 2003, Copyright 2001–2003, retrieved from www.plowshare.com on Jul. 8, 2003 46 pages.*
Plowshare Technologies, "Clinical Research Support System CReSSmicro/CReSShost User Guide", Revision 0.2, Published Jan. 27, 2003.
Plowshare Technologies, "Clinical Research Support System CReSSmicro/CReSShost User Guide", Revision 0.1, Published Aug. 10, 2002.
Plowshare Technologies, "Clinical Research Support System CReSSmicro/CReSShost User Guide", Revision 0.1, Published Mar. 28, 2002.
Wayne Kashinsky et al., "A Telemetric Device for Measuring Smoking Topography," Behavior Research Methods, Instruments and Computers 1995, 27(3), pp. 375–378.
David Satcher, MD, PhD, U.S. Surgeon General, "A Call for Action: Surgeon General's Report," Center for Disease Control (CDC), Reducing Tobacco Use, Apr. 10, 2002, pp. 1–4.

(List continued on next page.)

*Primary Examiner*—Steven P. Griffin
*Assistant Examiner*—Carlos Lopez
(74) *Attorney, Agent, or Firm*—Venabee; James R. Burdett

(57) ABSTRACT

A portable smoking topography apparatus for providing smoking topographical information, comprises a smoking material holder adapted to receive a smoking material; a smoking material detection sensor mounted on the smoking material holder and detecting presence or absence of a smoking material; a puff sensor detecting a puff of the smoking material by a subject; a clock; a computing unit coupled to smoking material sensor and the puff sensor, wherein the computing unit reads start time and end time of each puff from clock, reads sample flow rates of smoke from the smoking material during each puff, reads time of insertion of smoking material and time of removal of smoking material from clock as detected by smoking material detection sensor, calculates puff information. The computing unit calculates smoking material information. The portable smoking topography apparatus transfers at least one of puff information and smoking material information to a workstation. At least one of puff information and smoking material information is displayed on a display unit coupled to the workstation. The computing unit eliminates false puff.

33 Claims, 11 Drawing Sheets

OTHER PUBLICATIONS

Message from Donna E. Shalala, Secretary of Health and Human Services; Jeffrey P. Koplan, M.D. Director for CDC, and David Satcher, MD, PhD, U.S. Surgeon General, "Reducing Tobacco Use: A Report of the Surgeon General—Executive Summary," Atlanta, Georgia (Preface i–iii and pp. 1–22) 2000.

Preliminary Product Information, "Portable Smoking Topography Measurement Device," (Revisions from Jan./Feb. 2000 and Feb./Mar./Oct. 2001) Plowshare Technologies, Inc., Feb. 5, 2002, pp. 4–8.

P. Puustinen, et al., "Microcomputer Assisted Measurement of Inhalation Parameters During Smoking," Toxic Interferences of Neurones, Smoke and Genes, Arch. Toxicol. Suppl. 9, 111–114 (1986).

Pekka Puustinen et al., "Microcomputer–Aided Measurement of Puff Parameters During Smoking of Low– and Medium–Tar Cigarettes," Scand. J. Clin. Lab Invest. 1987; 47:665–600.

* cited by examiner

APPARATUS FOR MEASURING SMOKING TOPOGRAPHY

The U.S. Government has a paid-up license in this invention and the right in limited circumstances to require the patent owner to license others on reasonable terms as provided for by the terms of Grant No. 1R43DA13882-01 awarded by the National Institute on Drug Abuse.

BACKGROUND OF THE INVENTION

1. Field of the Invention

The present invention relates to an apparatus for measuring smoking topography.

2. Description of the Related Art

Tobacco use, particularly cigarette smoking, is the leading cause of preventable illness and death in the United States. Despite the availability of pharmacotherapies for tobacco dependence, each year more than 400,000 Americans die too young because of smoking-related diseases. Nearly, one in four U.S. Adults and one in three teenagers smoke. Tragically, if current trends continue, an estimated 25 million people (including 5 million of today's children) will die prematurely of smoking-related disease. Cigarette smoking costs an estimated 419,000 American lives and $100 billion in direct and indirect health care expenses annually (Center for Disease Control 1994).

As indicated in the Surgeon General's Report titled "Reducing Tobacco Use" published in the year 2000, tobacco dependence is currently viewed as a chronic disease with remission and relapse. Although interventions do provide some cessation from smoking, achieving long-term abstinence from smoking has been extremely difficult for smokers. There is little understanding of how various treatments produce therapeutic effects. Since the overall success in improving the public health depends upon a dramatic reduction in the rate of tobacco use, clinical researchers require state-of-the-art tools that will help identify factors that change smoking behavior. Tools that provide detailed measurements of smokers' puffing behavior have long been a mainstay in successful smoking research programs, and they continue to help clinical researchers understand the factors that influence tobacco use in the laboratory. Smoking topography or puff topography refers to the measures that assess puffing behavior.

Measurement of smoking topography variables such as puff volume, puff duration, inter-puff interval, peak flow, and the number of puffs by a smoker has been central to the study of smoking behavior. Smoking topography measurement has demonstrated that nicotine self-administration helps to drive tobacco use, and has predicted in the laboratory, the efficacy of nicotine replacement medications. Additionally, the sensitivity gained by puff topography measurement has uncovered factors that change cigarette use, including personality type, gender, time of day, and smoke dilution through filter ventilation holes. Smoking topography may be critical in the assessment of nicotine dependence in smokers. Thus, the ability to measure smoking topography is likely essential to comprehensive research programs tasked to understand and treat smoking behavior.

In the prior art, smoking topography measurement devices used a cigarette holder or mouthpiece that acts as a flowmeter to capture pressure differences as smoke is inhaled through the holder. A pressure sensor converts pressure to voltage, which is then converted to flow rate using calibrated computer software. While highly effective in a laboratory setting, these smoking topography devices share the disadvantage of relying on locally made hardware and software. Therefore, Plowshare® Technologies, Inc. developed the Clinical Research Support System (CReSS). This desktop system, based on well-tested measurement techniques, used an integrated Windows® platform that automates data collection in smoking topography. The primary components of the CReSS are a personal computer 1 running a Windows® operating system, a mouthpiece 3 holding a cigarette, and a measurement interface unit 2 connected to the personal computer 1 and mouthpiece 3 as shown in FIG. 1. CReSS assesses puffing behavior using a differential pressure flow meter contained in a plastic mouthpiece 1 tethered by vinyl tubing to a measurement interface unit 2. By measuring differential pressure at the two precisely placed taps in the mouthpiece 3, CReSS accurately calculates flow rate during each smoking inhalation. The relationship between differential pressure and flow rate is given by a power equation based on the respective diameters of the flow meter components and location of the pressure taps. When precise timing is correlated with instantaneous measured flow, smoking topographical information can be derived including: puff volume, puff duration, puff number, inter-puff interval (time between the end of one puff and the beginning of the next puff), and peak puff flow rate (highest sampled flow rate).

Although CReSS as a desktop or laptop measurement system provides smoking topographical information in a clinical laboratory setting, CReSS can not be used for smoking topography measurements outside of the intended clinical laboratory setting. It is simply impractical for a smoker to carry a personal computer 1, measurement interface unit 2, and a tethered mouthpiece 3 for ambulatory measurement during a smoker's daily routine. Therefore, CReSS is impractical for natural smoking topography measurements while a smoker is in his or her normal everyday environment.

Naturalistic observation of a smoker is very important in smoking research because the smoker's environment may influence smoking behavior. Some factors that modulate or change smoking behavior are environment-specific. These factors include the proximity of other smokers, the influence of smoking and non-smoking peers, and the availability of other reinforcing activities that are incompatible with smoking, such as physical activity. The relative influence of these factors may be studied most optimally in the natural environment, provided that adequate smoking topography measurement equipment is available. Studying cigarette behavior in the natural environment will be essential to understanding the etiology of tobacco dependence—why people alter their tobacco use patterns from first use, to occasional use, to eventual regular, daily use. Therefore, there is a need for providing a truly portable smoking topography measurement device or system capable of accurately measuring smoking topography wherever a smoker chooses to smoke. Moreover, there is a similar need for a smoking topography measurement device capable of measuring any substance, which can be inhaled through the mouth including other drugs such as marijuana.

BRIEF SUMMARY OF THE INVENTION

In one embodiment, a portable smoking topography apparatus for providing smoking topographical information, comprises: a smoking material holder adapted to receive a smoking material, wherein the smoking material holder has a smoking material detection sensor, which detects the presence or absence of a smoking material; means for detecting each puff of the smoking material by a subject;

means for measuring flow rate of smoke from the smoking material into a subject during each puff; means for computing puff information; means for eliminating false puffs from the puff information; and means for storing puff information in a memory. The means for computing puff information comprises means for computing a puff volume. The means for computing puff information comprises means for computing average flow rate. The means for computing puff information comprises means for computing peak flow rate.

The means for computing puff information comprises means for computing time of peak flow rate for each puff. The means for computing puff information comprises means for computing puff duration for each puff. The means for computing puff information comprises means for computing each inter-puff interval between puffs.

The portable smoking topography further comprises means for computing smoking material information. The means for computing smoking material information comprises means for computing the number of puffs per smoking material. The means for computing smoking material information comprises means for computing total smoking material time. The means for computing smoking material information comprises means for computing time to first puff. The means for computing smoking material information comprises means for computing time interval from the end of last puff of smoking material to smoking material removal.

The portable smoking topography apparatus further comprising means for transferring at least one of puff information and smoking material information to a workstation. The portable smoking topography apparatus further comprising means for displaying at least one of puff information and smoking material information on a display unit. The means for eliminating false puffs from the puff information comprises: means for identifying a false puff; means for calculating a time bias of the false puff; and means for applying the time bias to the inter-puff interval of the puff following the false puff. The means for computing puff information comprises means for computing a puff volume, and wherein means for eliminating false puffs from the puff information comprises: means for identifying puff as a false puff if the puff volume is less than a predetermined minimum; means for calculating a time bias of the false puff; and means for applying the time bias to the inter-puff interval of the puff following the false puff.

The means for computing puff information comprises means for computing a puff duration, and wherein means for eliminating false puffs from the puff information comprises: means for identifying puff as a false puff if the puff duration is less than a predetermined minimum; means for calculating time bias of the false puff; and means for applying time bias to the inter-puff interval of the puff following the false puff.

In the portable smoking topography apparatus, the means for computing puff information comprises: means for computing puff volume; means for computing puff duration; means for computing peak flow; means for computing time of peak flow; and means for computing average flow rate. The means for eliminating false puffs from the puff information comprises: means for comparing inter-puff interval of each puff to a predetermined minimum; means for identifying each puff having an inter-puff interval, which is less than a predetermined minimum puff as a false puff; and false puff elimination means for eliminating false puffs from the puff information.

In another embodiment, a portable smoking topography apparatus for providing smoking topographical information, comprises a smoking material holder adapted to receive a smoking material, wherein the smoking material holder has a smoking material detection sensor, which detects the presence or absence of a smoking material; means for detecting each puff of the smoking material by a subject; means for measuring flow rate of smoke from the smoking material into a subject during each puff; means for computing puff information; means for storing puff information in a memory; means for interfacing the portable smoking topography measurement unit with the workstation; means for transferring puff information from the memory to the workstation; and means for displaying the puff information on a display unit.

The portable smoking apparatus further comprises means for authenticating puff information before puff information is transferred from the memory to the workstation. A portable smoking topography apparatus further comprises means for eliminating false puffs from the puff information. The portable smoking topography apparatus further comprises means for computing smoking material information, and means for storing smoking material information in the memory. The portable smoking topography apparatus further comprises means for authenticating puff information and smoking material information before the puff information and smoking material information is transferred from the memory to the workstation.

In another embodiment, a portable smoking topography apparatus for providing smoking topographical information, comprises a smoking material holder adapted to receive a smoking material; a smoking material detection sensor mounted on the smoking material holder and detecting presence or absence of a smoking material; a puff sensor detecting a puff of the smoking material by a subject; a clock; a computing unit coupled to smoking material sensor and the puff sensor, wherein the computing unit reads start time and end time of each puff from clock, reads sample flow rates of smoke from the smoking material during each puff, reads time of insertion of smoking material and time of removal of smoking material from clock as detected by smoking material detection sensor, calculates puff information. The computing unit calculates smoking material information. The portable smoking topography apparatus transfers at least one of puff information and smoking material information to a workstation. At least one of puff information and smoking material information is displayed on a display unit of the workstation. The computing unit eliminates false puffs.

DETAILED DESCRIPTION OF THE INVENTION

Exemplary embodiments of the invention are discussed in detail below. While specific exemplary embodiments are discussed, it should be understood that this is done for illustration purposes only. A person skilled in the relevant art will recognize that other components and configurations can be used without parting from the spirit and scope of the invention. The embodiments and examples discussed herein are non-limiting examples.

Figure 1:
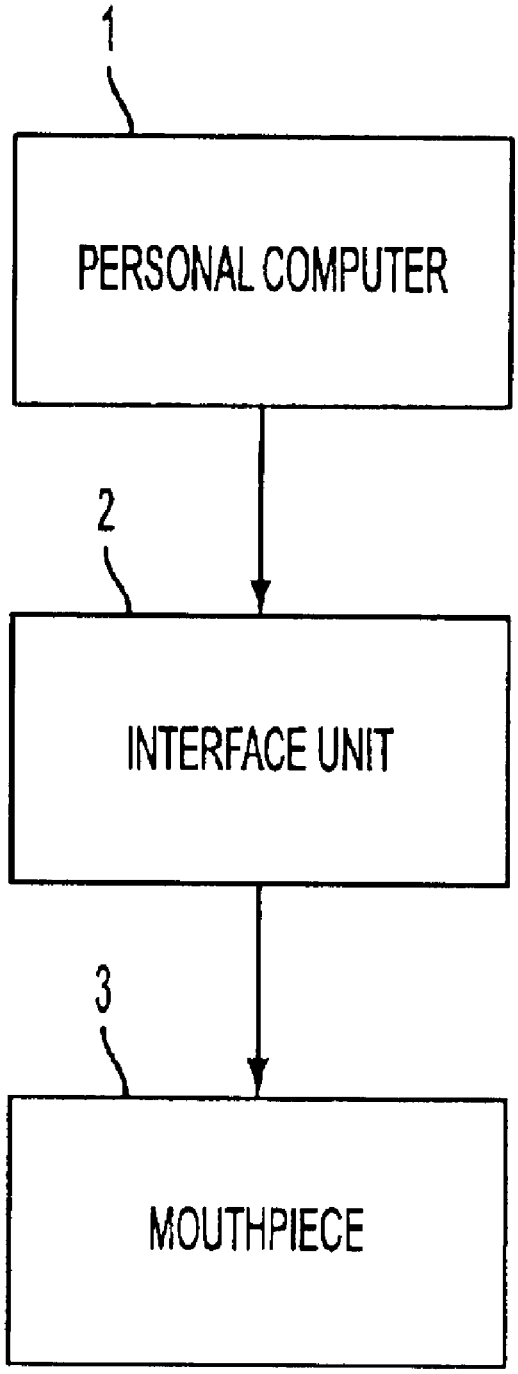
FIG. 1 (PRIOR ART)
FIG. 1 is a block diagram of a prior art smoking topography measurement device.
Figure 2:
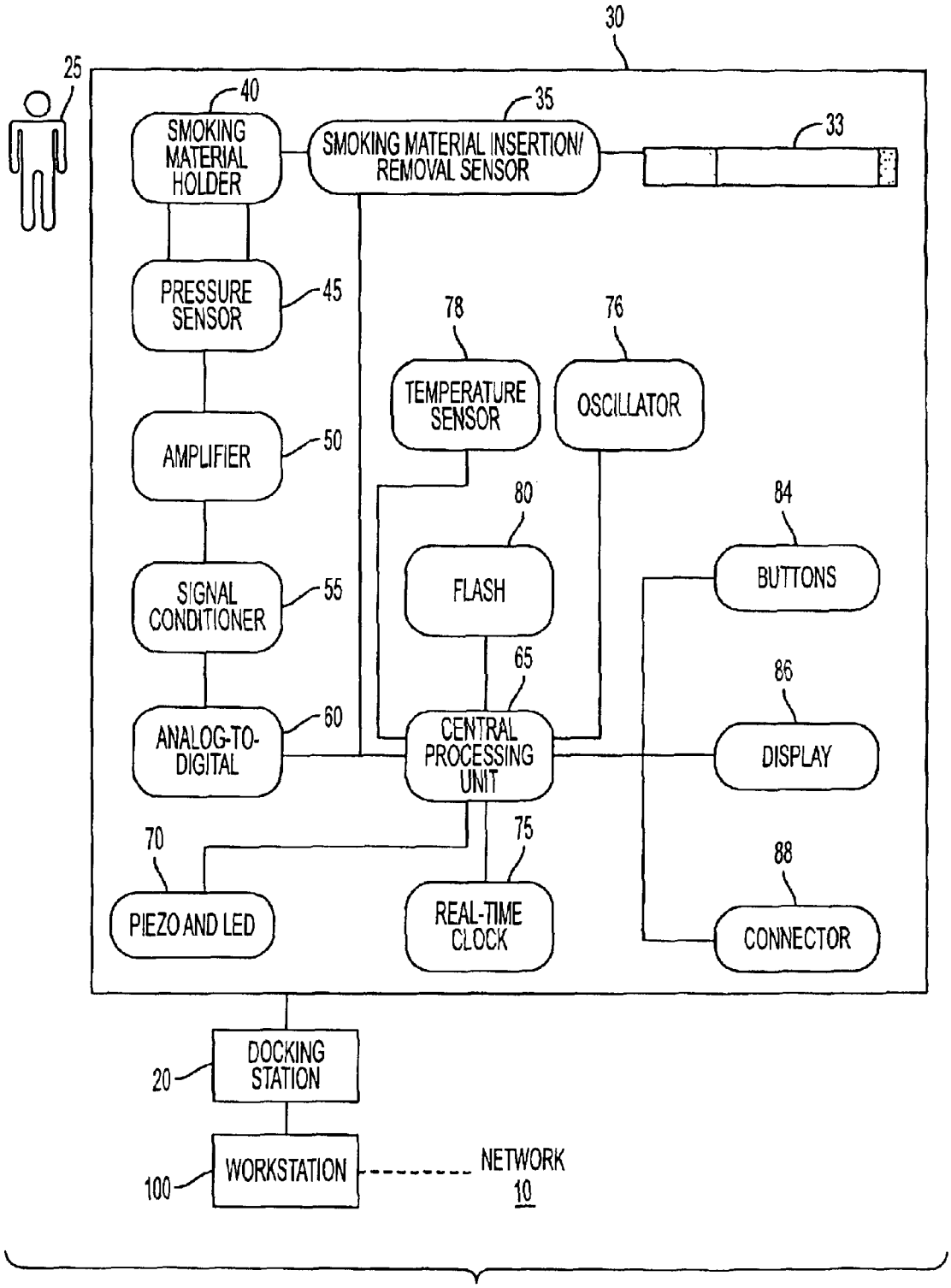
FIG. 2 is a block diagram of a portable smoking topography measurement system in accordance with an embodiment of the present invention.

FIG. 2 is a block diagram of a portable smoking topography measurement system in accordance with an embodiment of the present invention. FIG. 2 shows a stand-alone workstation 100, which may be communicating with a network 10. The workstation 100 is preferably coupled to a docking station 20 adapted to receive a portable smoking topography measurement unit 30. The docking station 20 permits the workstation 100 to download smoking topography data from the portable smoking topography measurement unit 30. The docking station 20 also permits the workstation to configure the portable smoking topography measurement unit 30 for use in a clinical study and charge a battery (not shown). The smoking topography information (smoking topography data) may include actual samples or measurements taken by the smoking topography measurement unit 30 as well as information derived from the actual samples or measurements using a computer software program contained in the smoking topography measurement unit 30.

A subject 25 (person) carries the portable smoking topography measurement unit 30. When the subject 25 wishes to smoke, the subject 25 places a smoking material 33 into the smoking material holder 40 of the smoking topography measurement unit 30. The smoking material 33 may be a tobacco product such as a cigar or cigarette. Alternatively, the smoking material 33 may include another drug such as marijuana. The smoking material 33 is intended to comprise any substance, which can be inhaled through the mouth by a subject. A smoking material insertion/removal sensor 35, mounted to the smoking material holder 40, senses the presence or absence of a smoking material 33. The smoking topography measurement unit 30 includes a pressure sensor 45 sensing the pressure caused by the subject 25 puffing a smoking material 33. There is a mathematical relationship between the sensed pressure and the flow rate of smoke into the subject 25. The flow rate is directly proportional to the square root of the pressure differential created by the flow within the smoking material holder 40. The general equation is, where Y is the flow rate term. The constant m is an empirically-derived constant based on the respective diameters of the flow meter components, the location of the pressure taps, and the discharge coefficient of the flow meter. The term X represents the differential pressure, which is the analog signal emitted by the pressure sensor 45. The pressure sensor 45 outputs an analog signal to an amplifier 50, which amplifies the analog signal. A signal conditioner 55 receives an amplified analog signal from the amplifier 50, and transmits the conditioned (filtered) signal to the analog to digital converter 60, which converts the analog signal to digital data representing the sensed pressure caused by the subject 25 puffing a smoking material 33. A central processing unit 65 (microprocessor, processor, or other computing device) receives and processes the digital data to provide the flow rate (Y) of smoke into the subject 25. The central processing unit 65 stores the digital data in a flash memory 80. The flash memory 80 also stores the software program for operating the smoking topography measurement unit 30 including making smoking topography measurements (smoking topography data collection), and for deriving smoking topography information. Alternatively, the central processing unit 65 may have an internal flash, which may store the software program for operating the smoking topography measurement unit 30. A piezo buzzer for audible confirmations and an LED for visible indications of device status or other information 70 are connected to the central processing unit 65. (The piezo and LED 70 are optional). A real time clock 75 supplies a running time and date to the central processing unit 65. An oscillator 76 supplies a clock signal to the central processing unit 65. A temperature sensor 78 supplies an operating temperature to the central processing unit 65. The smoking topography measurement device 30 may also include buttons 84 for user interaction, a display (e.g. liquid crystal display) 86 for displaying status and other information, and a connector 88 for connecting the portable smoking topography measurement unit 30 to the docking station 20. (The buttons 84 and display 86 are optional). Although connecting the portable smoking topography measurement unit 30 to the workstation 100 by docking station 20 is preferable, the portable smoking topography measurement unit 30 may be connected directly to the workstation 100 by a cable.

Figure 3:
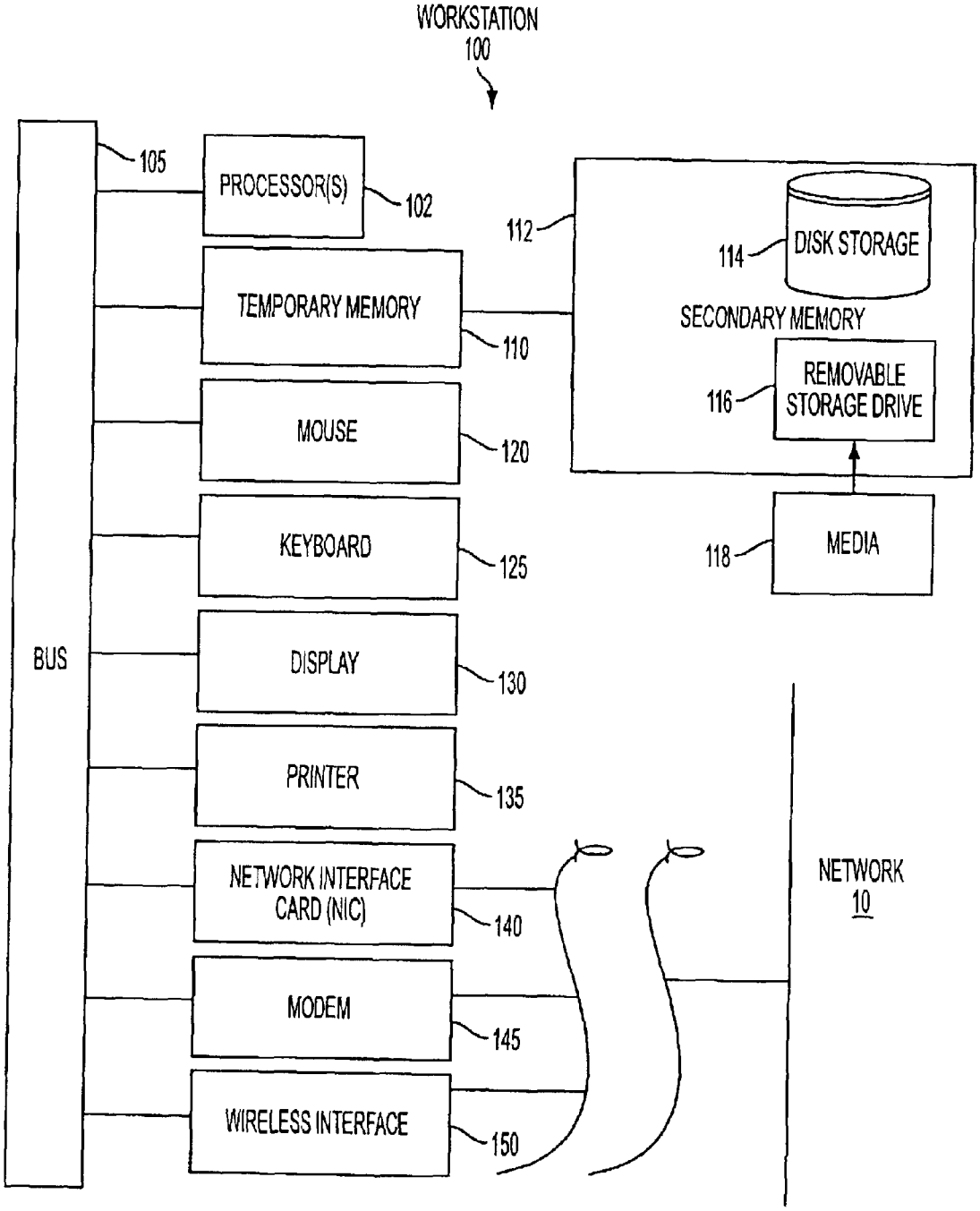
FIG. 3 is a block diagram of a workstation.

FIG. 3 shows a block diagram of a workstation 100 coupled to the network 10, which provides an example of hardware which may be used in implementing certain aspects of the invention. Workstation 100 preferably includes one or more processors 102 coupled to a bus 105. The bus 105 can be coupled to any of various subsystems including: a temporary memory 110; a secondary memory 112 such as, a disk 114, and/or a removable storage drive 116 into which media 118 can be placed including, e.g., a diskette, a compact diskette (e.g. CD ROM) or the like; an input device such as a mouse 120, or a keyboard 125; an output device such as a display 130 or printer 135; and input/output (I/O) devices to a network 10 such as network interface card (NIC) 140 such as an Ethernet, Token Ring, Smart and Asynchronous Transfer Mode (ATM) cards. Other input/output devices may include a modem 145, or other input/output device such as, a wireless interface 150 (e.g. a wireless transceiver). It will be apparent to those skilled in the relevant art that the above-described workstation 100 has been provided as an example and is not intended to limit the breadth of the invention in any way. The software accessing data from the portable smoking topography measuring unit 30 may be stored on any storage medium, which can be accessed by the workstation 100.

Figure 4:
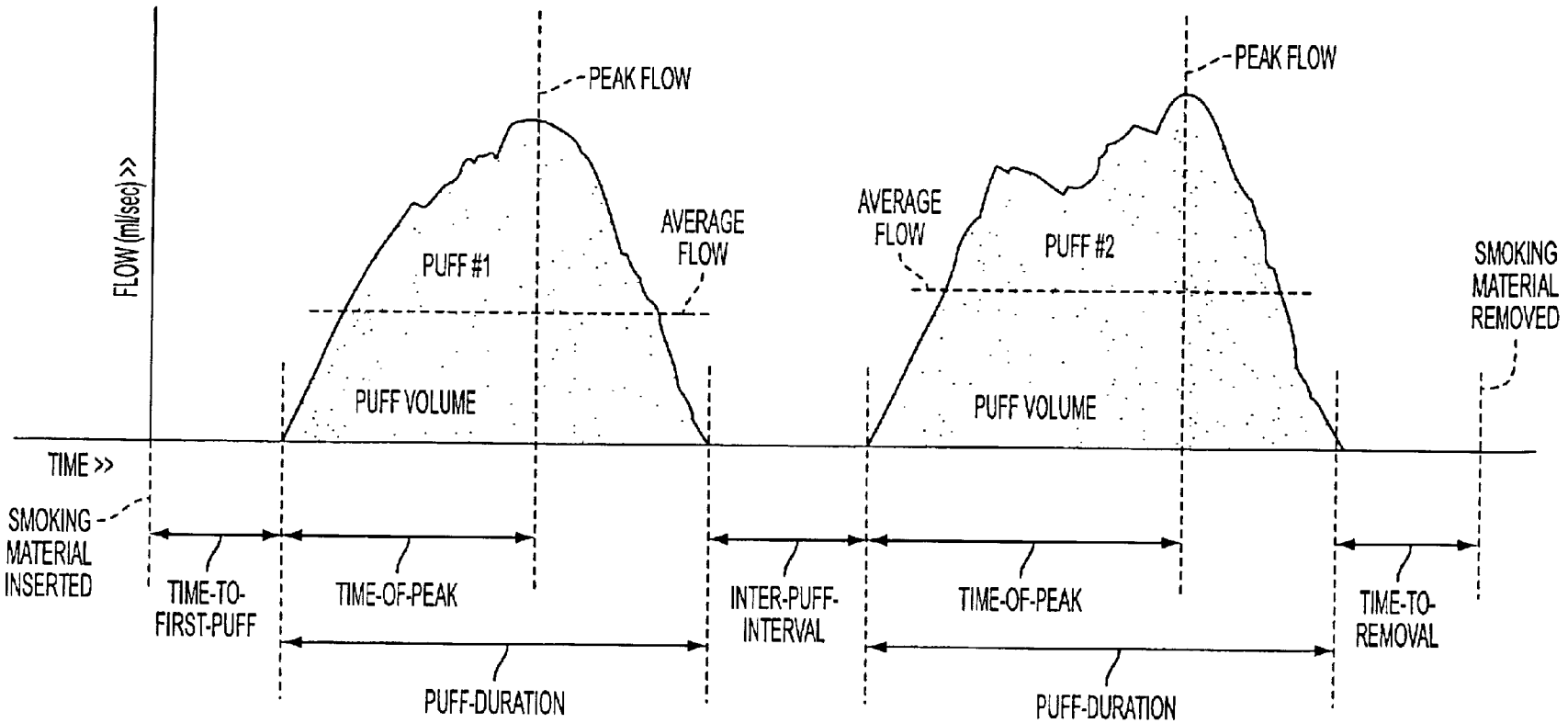
FIG. 4 is a diagram showing an example of puff information.

The portable smoking topography measuring unit 30 measures, analyzes, and computes a large number of smoking characteristics or smoking topographical information including: puff volume, puff duration, inter-puff interval, peak puff flow rate during puff, time of peak puff flow rate, mean flow during puff, puffs per smoking material, total smoking material time, time to first puff of smoking material, time to removal of smoking material, total smoking material volume, smoking materials per hour, smoking materials per day, smoking materials per week, smoking materials per month, date and time of the start and end of each smoking material smoked, and environmental temperature. These smoking characteristics are collectively known as "smoking topography." Further, these smoking characteristics may be divided into three categories: puff information, smoking material information, and environment. The puff information category includes at least one of the following: puff volume, puff duration, inter-puff interval, peak puff flow rate, time of peak puff flow rate, and mean (average) puff flow rate. (See example shown in FIG. 4). The smoking material information category includes at least one of the following: puffs per smoking material, total smoking material time, time to first puff of smoking material, time to removal of smoking material, total smoking material volume, smoking materials per hour, smoking materials per day, smoking materials per week, smoking materials per month, and date and time each smoking material smoked. The environment category includes environmental temperature.

Puff volume is the amount of smoke drawn by the subject 25 in one puff.

Puff duration is time between the start and end of a puff by a subject 25.

Inter-puff interval (IPI) is the length of time between the start of one puff and the end of the immediately preceding puff of the smoking material 33 by the subject 25.

Peak puff flow rate is the highest flow rate of smoke into the subject 25 during a puff.

Time of peak puff flow rate is the point in time when the highest flow rate of smoke into the subject 25 during a puff is recorded.

Mean puff flow rate is the average flow rate of smoke into the subject 25 during a puff.

Puffs per smoking material 33 is the number of draws of smoke by the subject 25 of one smoking material 33.

Total smoking material time is the amount of time a subject 25 has a smoking material 33 in the smoking material holder 40.

Time to first puff of smoking material 33 is the amount of time between the insertion of the smoking material 33 into the smoking material holder 40 and the start of the first puff by the subject 25.

Time to removal of smoking material 33 is the amount of time between the end of the last puff of the smoking material 33 and the removal of smoking material 33 from the smoking material holder 40.

Total smoking material volume is the total amount of smoke drawn by the subject 25 for one smoking material.

Smoking materials per hour is the number of smoking materials 33 inserted and removed from the smoking material holder 40 per hour.

Smoking materials per day is the number of smoking materials 33 inserted and removed from the smoking material holder 40 per day.

Smoking materials per week is the number of smoking materials 33 inserted and removed from the smoking material holder 40 per week.

Smoking materials per month number of smoking materials 33 inserted and removed from the smoking material holder 40 per month.

Date and time each smoking material smoked is the date and time at which each smoking material 33 is inserted into the smoking material holder 40 and the date and time at which the smoking material 33 is removed from the smoking material holder 40.

Environmental temperature is the temperature within the portable smoking topography measurement unit as detected by the temperature sensor 78. The temperature is recorded when the smoking material 33 is first detected by the smoking material insertion/removal sensor 35. It may be used for tracking the use of the device under different environmental conditions.

FIGS. 5–9 are flowcharts showing one embodiment of the present invention. While the smoking material holder 40 of the portable smoking topography measurement unit 30 does not have a smoking material 33, the portable smoking topography measurement unit 30 is preferably in the idle mode (step 200) to conserve battery power. Once the smoking material insertion/removal sensor 35 mounted to the smoking material holder 40 recognizes that a smoking material 33 has been placed in the smoking material holder 40 (step 210), the strength of the battery is preferably checked (step 220). However, the strength of the battery may be checked routinely regardless of whether insertion of a smoking material 33 has been detected by insertion/removal sensor 35. If the battery is not charged, then the portable smoking topography measurement unit 30 remains in idle (step 200).

If the battery has sufficient power and the smoking material insertion/removal sensor 35 senses a smoking material 33 in the smoking material holder 40, the central processing unit 65 preferably reads the real-time and date from the real-time clock 75, and preferably reads the temperature from the temperature sensor 78 after the central processing unit 65 receives an analog signal from the smoking material insertion/removal sensor 35 (step 230). However, the temperature could be read at any time before the puff information is calculated. The time, date, and temperature are preferably stored in the flash memory 80 (step 240), and the smoking material timer is started (step 250). The pressure sensor 45, amplifier 50, signal conditioner (filter) 55, and analog-to-digital converter 60 are enabled so that the central processing unit 65 can receive digital data representing flow measurements (step 270).

The pressure sensor 45 preferably detects when a subject 25 starts to puff a smoking material 33 (step 275). If the pressure sensor 45 does not detect a puff after a first predetermined time, the central processing unit 65 checks whether the smoking material 33 has been removed from the smoking material holder 40 or a second predetermined time has passed (step 280). The first and second predetermined time may be the same or different. If the smoking material 33 is still inserted in the smoking material holder 40 and a second predetermined time has not passed, then the pressure sensor 45 and central processing unit 65 continue to wait for an indication of a puff from the pressure sensor 45 (step 270). However, if the central processing unit 65 receives a signal from the smoking material insertion/removal sensor 35 indicating that the subject 25 has removed the smoking material 33 or the second predetermined time has elapsed (step 280), the battery is preferably checked (step 285). If the battery has sufficient power, the smoking material information is calculated (step 286) by using the measured (collected) digital data. Then, the smoking material information is stored in the flash 80, and a sound is preferably emitted (e.g. beeps) (step 290). Subsequently, flow measurement is disabled by disabling the pressure sensor 45, the amplifier 50, the signal conditioner 55, and the analog-to-digital converter 60. The central processing unit 65 reads the time and date from the real time clock 65, and the central processing unit 65 stores the time and date in the flash 80. Further, the smoking material timer is stopped (step 295). The smoking topography measuring unit 30 remains in idle (step 200) until the smoking material insertion/removal sensor 35 senses a smoking material 33 placed in the smoking material holder 40 (step 205).

If the battery does not have sufficient power (step 285), then the flow measurement is disabled by disabling the pressure sensor 45, the amplifier 50, the signal conditioner 55, and the analog-to-digital converter 60. Further, the central processing unit 65 preferably reads the time and date from the real time clock 75, and the central processing unit 65 stores the time and date in the flash 80. Further, the smoking material timer is stopped (step 295). The smoking topography measuring unit 30 remains in idle (step 200) until the smoking material insertion/removal sensor 35 senses a smoking material 33 placed in the smoking material holder 40 (step 205), and the battery has sufficient power (step 210).

As discussed above, the pressure sensor 45 preferably detects when a subject 25 starts to puff a smoking material 33 (step 275). If the pressure sensor 45 detects a subject 25 starting a puff, the flow samples are collected (step 300). If the puff has not ended (step 305), then the central processing unit 65 checks whether the smoking material 33 has been removed from the smoking material holder 40 or a predetermined time has passed (step 306). If the smoking material 33 is still inserted in the smoking material holder 40 and the predetermined time has not passed, then the pressure sensor 45 and central processing unit 65 continue to collect flow samples (step 300). Each time a sample is taken (collected), a sample counter is incremented. However, if the central processing unit 65 receives a signal from the smoking material insertion/removal sensor 35 indicating that the subject 25 has removed the smoking material 33 or the predetermined time has elapsed (step 306), then steps 285, 286, 290, 295, and 200 are performed as necessary.

If the puff has ended (step 305), a puff counter is incremented (step 308), the collected flow samples (collected data) are processed, and several calculations are performed including puff duration, inter-puff interval, average puff flow rate, puff volume, peak puff flow rate, and time of peak puff flow rate to provide some puff information (step 310).

Figure 7:
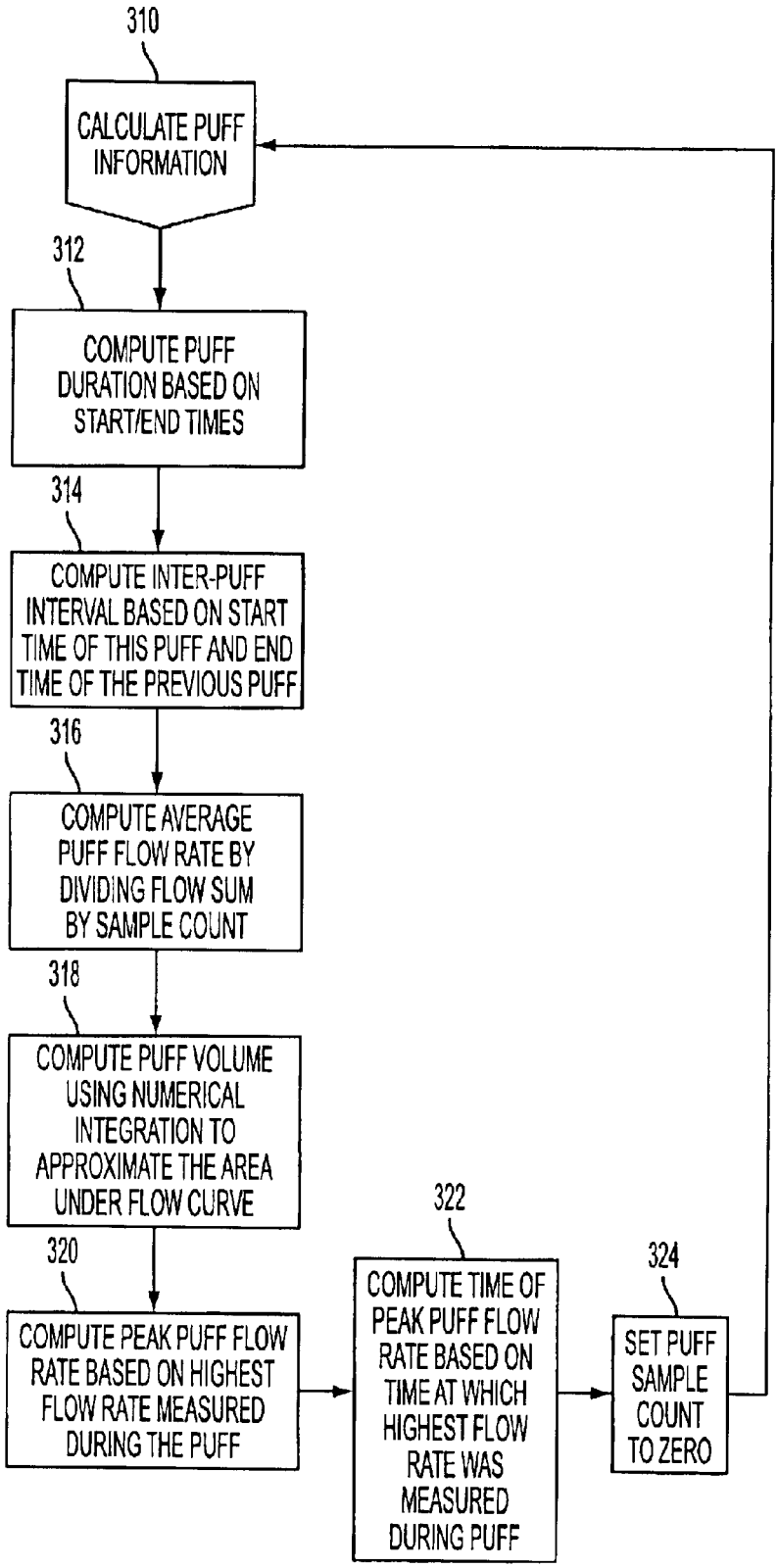

As shown in FIG. 7, the difference between the start time and the end time of the puff is calculated to provide the puff duration (step 312). The duration of the inter-puff interval is the length of time between the start time of the just measured puff and the end time of the immediately preceding puff (step 314). The average puff flow rate is computed by dividing sum of the measured flow rate samples by the number of samples taken during the puff duration (sample count) (step 316). A flow rate sample is measured by taking a sample (voltage), representing the instantaneous pressure differential in the smoking material holder 40. As discussed above, the flow rate sample is directly proportional to the square root of the pressure differential created by the flow within the smoking material holder 40. The general equation is $Y=mX^{1/2}$ where Y is the flow rate term. The constant m is an empirically-derived constant based on the respective diameters of the flow meter components, the location of the pressure taps, and the discharge coefficient of the flow meter. The term X represents the differential pressure, which is the analog voltage emitted by the pressure sensor 45.

The puff volume is calculated by approximating the area under the flow curve using numerical integration (step 318). Preferably, to minimize error, the numerical integration method utilizes the trapezoidal rule to approximate the area under the flow curve. Alternatively, the numerical integration method may utilize Romberg Integration, Simpson's ⅓ Rule, and Simpson's ⅜ Rule. The puff flow rates sampled during a puff are compared to each other to determine the puff peak flow rate (step 320). The time associated with the puff peak flow rate is also ascertained (step 322). After the puff information is calculated, the puff sample count is set to zero (324).

Figure 8:
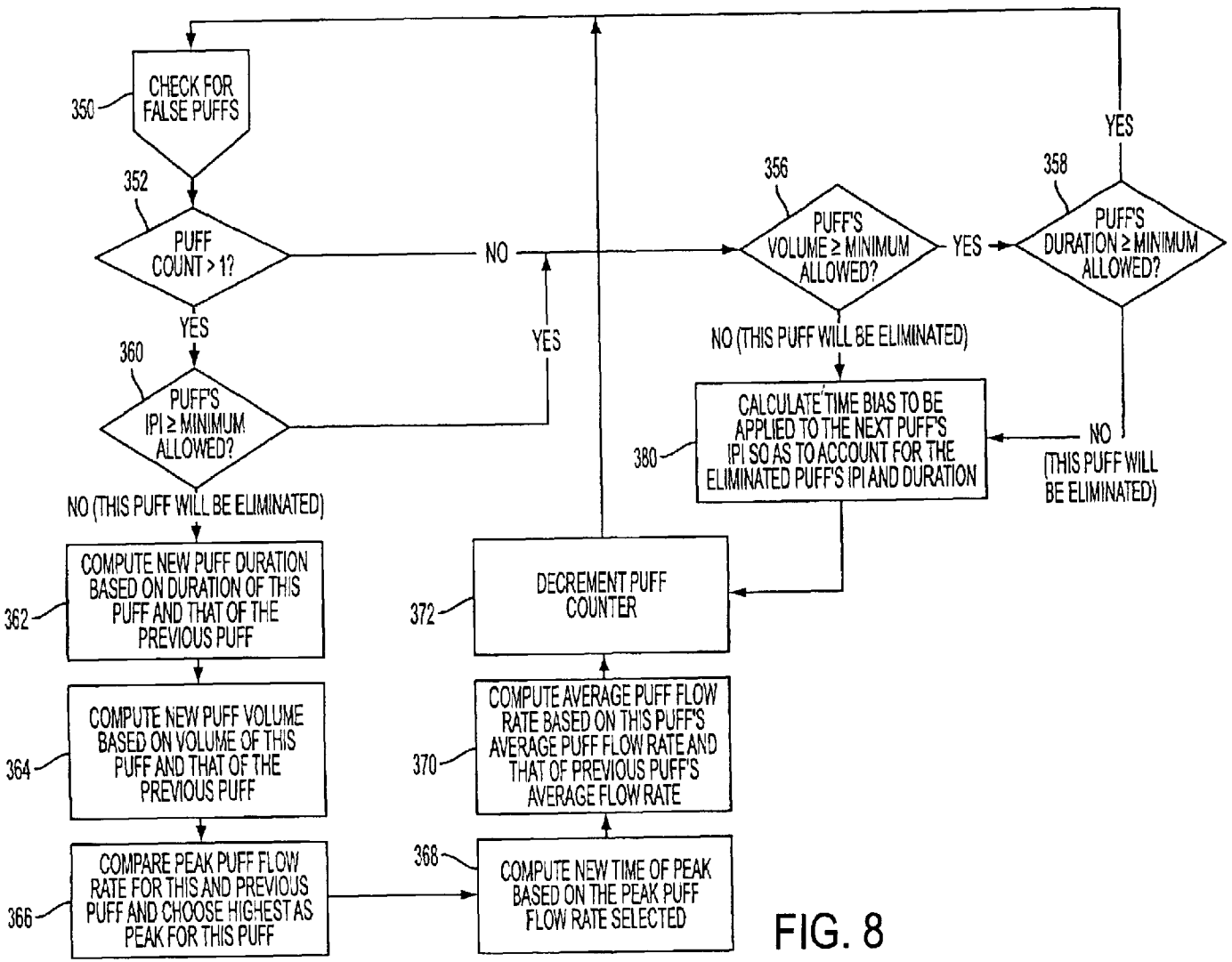

Once the puff information has been calculated, puff information is examined to determine whether a false puff has been detected (350). If a false puff is detected, it is eliminated (step 350, FIG. 8). False puffs are generally small puffs caused by a variety of environmental factors including noise, ashing of the smoking material, subject speaking, etc. False puffs are not representative of the subject's true smoking behavior and are preferably eliminated from the data in real time. As shown in FIG. 8, if the puff count kept by a puff counter (step 308) is zero or one (step 352), the puff's volume is greater than or equal to the predetermined minimum allowed (step 356), and the puff's duration is greater than or equal to the predetermined minimum puff duration allowed (step 358), then the puff is accepted as a measurement.

If the puff count is greater than one (step 352), the puff's inter-puff interval (IPI) is greater than or equal to the predetermined minimum allowed (step 360), the puff's volume is greater than or equal to the predetermined minimum allowed (step 356), and the puff's duration is greater than or equal to the predetermined minimum puff duration allowed (step 358), then the puff is accepted as a measurement.

If the puff count is greater than one (step 352) and the puff's IPI is less than the predetermined minimum (step 360), then a false puff has been detected, and this false puff must be eliminated, so that the portable smoking topography measuring unit 30 stores the proper smoking topographical information (smoking topographical data). If the puff's IPI is less than the predetermined minimum (step 360), a new puff duration is calculated based on the duration of this false puff, and the duration of the immediately preceding puff (step 362). A new puff volume is calculated based on the volume of the false puff and the immediately preceding puff (step 364). A new peak puff flow rate is calculated based on a comparison of the peak puff flow rate of the false puff and the peak puff flow rate of the immediately preceding puff. The higher of the two peak puff flow rates becomes the peak puff flow rate (step 366). The new time of the peak puff flow rate is determined based on the peak puff flow rate selected in step 366 (step 368). A new average puff flow rate is calculated based on the false puff's average puff flow rate and the immediately preceding puff's average puff flow rate (step 370). In order to calculate this new average puff flow rate, one or both of the false puff average flow rate and immediately preceding puff average flow rate may need to be weighted. Since the puff counter was incremented due to the false puff, the puff counter must be decremented (step 372). This completes the elimination of the false puff (step 350).

Returning to steps 352 and 360, if the puff count is not greater than one (step 352) or the puff's IPI is greater than or equal to the predetermined minimum allowed (step 360), then the system checks whether the calculated puff volume is less than a predetermined minimum volume (step 356). If the puff volume is less than the predetermined minimum volume (step 356), then the puff is a false puff. The system calculates a time bias to be applied to the next puff's IPI so as to account for the eliminated puffs IPI and duration (step 380), and the system decrements the puff counter (372). Also, if the puff's duration is less than the predetermined minimum duration (step 358), then the puff is a false puff. The system calculates a time bias to be applied to the next puff's IPI so as to account for the eliminated puffs IPI and duration (step 380), and the system decrements the puff counter (372). The positions of steps 356 and 358 may be switched in the flow chart in FIG. 8. This completes the elimination of the false puff (step 350).

Figure 5:
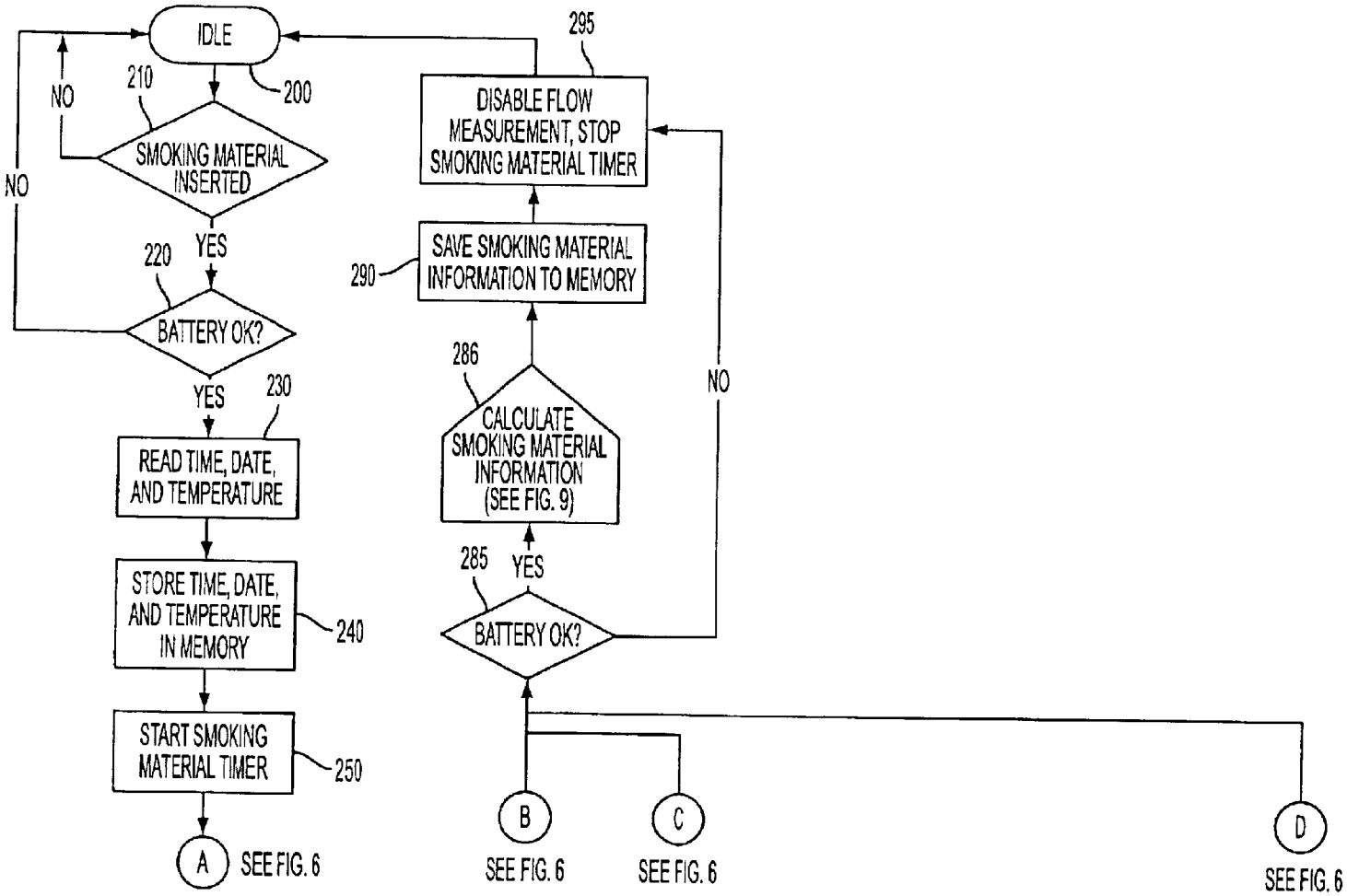
FIGS. 5–9 are flowcharts showing one embodiment of the present invention.
Figure 6:
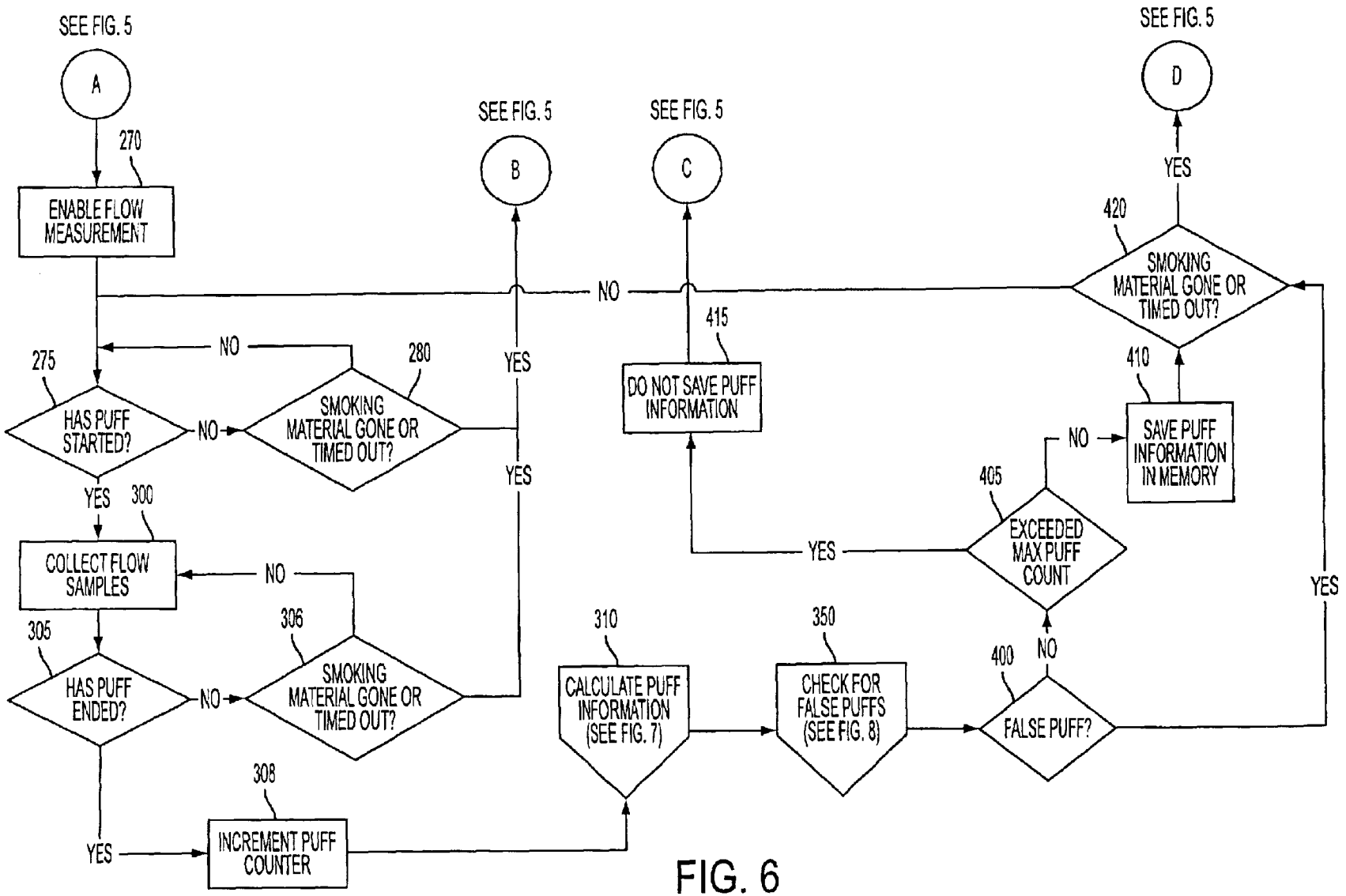

Referring to FIGS. 5–6, if a puff was accepted as a true puff (step 400) and the puff count has not exceeded a predetermined maximum puff count (405), then the puff information is saved in memory (410). If a puff was accepted as a true puff (step 400) and the puff count has exceeded a predetermined maximum puff count (405), then the puff information is not stored in memory (415). If a puff was found to be false (step 400), then the portable topography measurement unit 30 determines whether the smoking material 33 is still in the smoking material holder 40 and whether a predetermined time has been exceeded (step 420). If the smoking material 33 has been removed from the smoking material holder 40 or a predetermined amount of time has been exceeded (step 420), then the portable topography measurement unit 30 performs steps 285, 286, 290, 295, and 200 as necessary. If the smoking material 33 has not been removed from the smoking material holder 40 and a predetermined time has not been exceeded (step 420), then flow measurements to measure (collect) sample data continues (steps 275–420).

Figure 9:
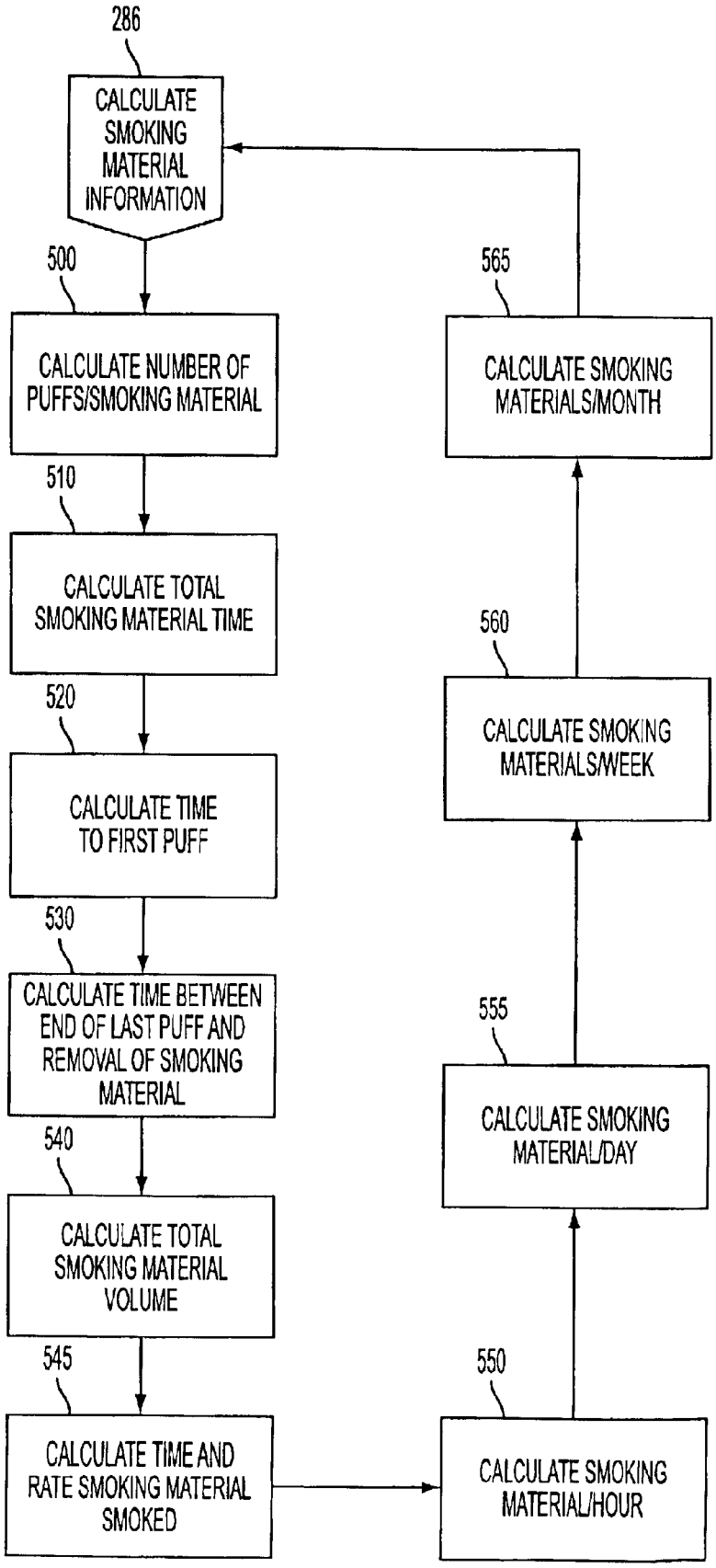

FIG. 9 is a flow chart showing the calculation of smoking material information of step 286. The following smoking material information is derived from smoking material measurements: puffs/smoking material (step 500); total smoking material time (step 510); time to first puff (step 520); time from the end of the last puff to removal of smoking material (step 530); total smoking material volume (step 540); smoking materials/hour (step 550); smoking materials/day (step 555); smoking materials/week (step 560); and smoking materials/month (step 565).

Figure 10:
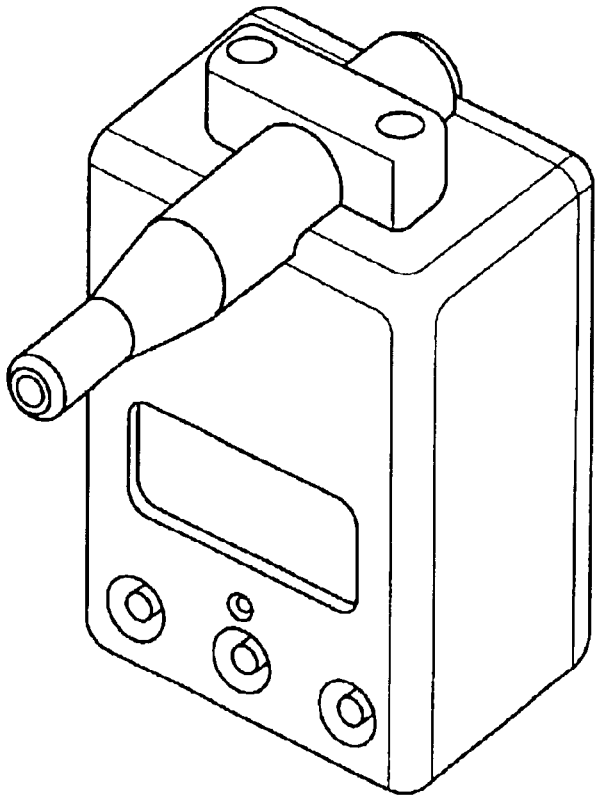
FIG. 10 is a depiction of a portable topography measurement device of the present invention.
Figure 11:
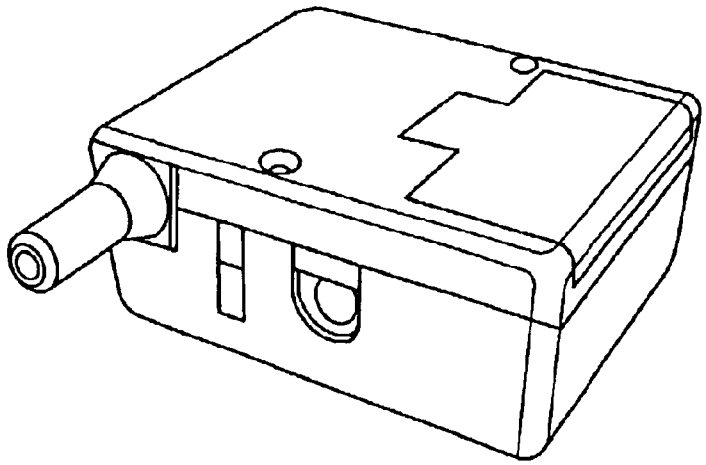
FIG. 11 is a depiction of another portable smoking topography measurement device of the present invention.

FIGS. 10 and 11 are depictions of the portable topography measurement devices.

As discussed above with reference to FIGS. 2 and 3, the portable smoking topography measurement unit 30 collects the smoking topography data and performs calculations to provide smoking topography information. A user preferably places the portable smoking topography measurement unit 30 in the docking station 20. The workstation 100 and portable smoking topography workstation 30 perform a hand shaking process by way of the docking station 20, which includes an authentication process. If the portable smoking measurement unit 30 is authenticated, then the smoking topography information is downloaded into a memory of the workstation 100. Alternatively, the portable topography measurement unit 30 may perform only some of the calculations discussed above, and download both smoking topography data and smoking topography information to the workstation 100. Subsequently, workstation 100 may perform calculations using the smoking topography data to provide additional smoking topography information. For example, generating charts, graphs, and/or diagrams showing measures over time and/or aggregated measures for the purposes of higher level analysis. After the smoking topography information has been downloaded or calculated, the smoking topography may be displayed on a display 130.

Figure 12:
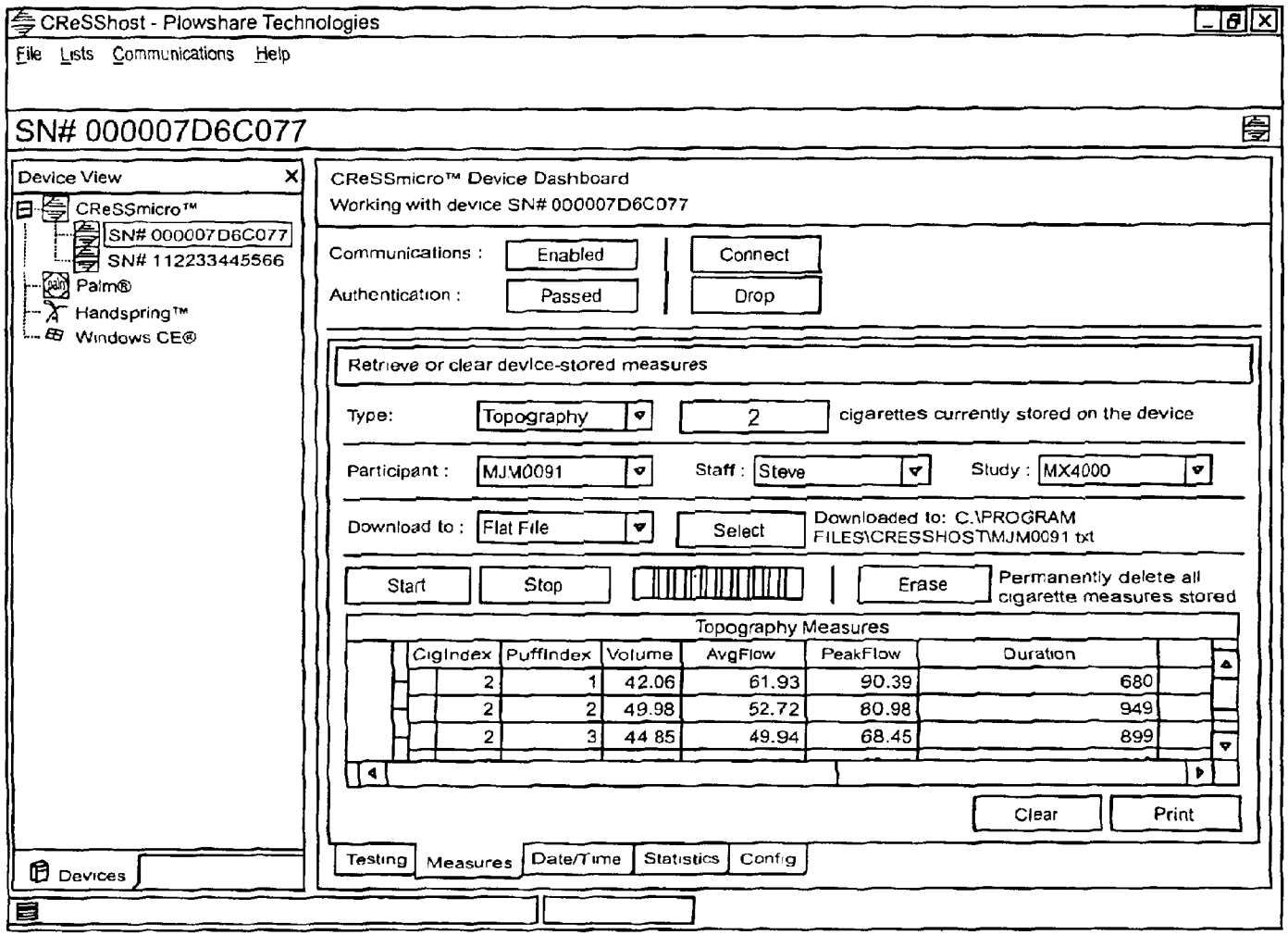
FIG. 12 is an example of a display of smoking topography information.

FIG. 12 provides an example of a display of smoking topography information.

Although the invention has been described for use with the Internet, web servers, and web pages, other types of networks, networking devices, and networked displayable information can be used with the invention, as will be appreciated by those skilled in the art. The embodiments and examples discussed herein are non-limiting examples.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A portable smoking topography apparatus for providing smoking topographical information, comprising:

a smoking material holder adapted to receive a smoking material, wherein the smoking material holder has a smoking material detection sensor, which detects the presence or absence of a smoking material;

means for detecting each puff of the smoking material by a subject;

means for measuring flow rate of smoke from the smoking material into a subject during each puff;

means for computing puff information;

means for eliminating false puffs from the puff information; and means for storing puff information in a memory.

2. The portable smoking topography apparatus of claim 1, wherein the means for computing puff information comprises means for computing a puff volume.

3. The portable smoking topography apparatus of claim 1, wherein the means for computing puff information comprises means for computing average flow rate.

4. The portable smoking topography apparatus of claim 1, wherein the means for computing puff information comprises means for computing peak flow rate for each puff.

5. The portable smoking topography apparatus of claim 1, wherein the means for computing puff information comprises means for computing time of peak flow rate for each puff.

6. The portable smoking topography apparatus of claim 1, wherein the means for computing puff information comprises means for computing puff duration for each puff.

7. The portable smoking topography apparatus of claim 1, wherein the means for computing puff information comprises means for computing each inter-puff interval between puffs.

8. The portable smoking topography apparatus of claim 1, further comprising means for computing smoking material information.

9. The portable smoking topography apparatus of claim 8, wherein the means for computing smoking material information comprises means for computing the number of puffs per smoking material.

10. The portable smoking topography apparatus of claim 8, wherein the means for computing smoking material information comprises means for computing total smoking material time.

11. The portable smoking topography apparatus of claim 8, wherein the means for computing smoking material information comprises means for computing time to first puff.

12. The portable smoking topography apparatus of claim 8, wherein the means for computing smoking material information comprises means for computing time interval from the end of the last puff of smoking material to smoking material removal.

13. The portable smoking topography apparatus of claim 8, further comprising means for transferring at least one of puff information and smoking material information to a workstation.

14. The portable smoking topography apparatus of claim 8, further comprising means for displaying at least one of puff information and smoking material information on a display unit.

15. The portable smoking topography apparatus of claim 2, wherein the means for eliminating false puffs from the puff information comprises:

means for identifying a false puff;

means for calculating a time bias of the false puff; and means for applying the time bias to the inter-puff interval of the puff following the false puff.

16. The portable smoking topography apparatus of claim 1, wherein the means for computing puff information comprises means for computing a puff volume, and wherein means for eliminating false puffs from the puff information comprises:

means for identifying puff as a false puff if the puff volume is less than a predetermined minimum;

means for calculating a time bias of the false puff; and means for applying the time bias to the inter-puff interval of the puff following the false puff.

17. The portable smoking topography apparatus of claim 1, wherein the means for computing puff information comprises means for computing a puff duration, and wherein means for eliminating false puffs from the puff information comprises:

means for identifying puff as a false puff if the puff duration is less than a predetermined minimum;

means for calculating a time bias of the false puff; and means for applying the time bias to the inter-puff interval of the puff following the false puff.

18. The portable smoking topography apparatus of claim 1, wherein the means for computing puff information comprises:

means for computing puff volume;

means for computing puff duration;

means for computing peak flow;

means for computing time of peak flow; and means for computing average flow rate.

19. The portable smoking topography apparatus of claim 18, wherein the means for eliminating false puffs from the puff information comprises:

means for comparing inter-puff interval of each puff to a predetermined minimum;

means for identifying each puff having an inter-puff interval, which is less than a predetermined minimum puff as a false puff; and false puff elimination means for eliminating false puffs from the puff information.

20. A portable smoking topography apparatus for providing smoking topographical information, comprising:

a smoking material holder adapted to receive a smoking material, wherein the smoking material holder has a smoking material detection sensor, which detects the presence or absence of a smoking material;

means for detecting each puff of the smoking material by a subject;

means for measuring flow rate of smoke from the smoking material into a subject during each puff;

means for computing puff information;

means for storing puff information in a memory;

means for interfacing the portable smoking topography measurement unit with the workstation;

means for transferring puff information from the memory to a workstation; and means for displaying the puff information on a display unit.

21. The portable smoking apparatus of claim 20, further comprising means for authenticating puff information before puff information is transferred from the memory to the workstation.

22. A portable smoking topography apparatus of claim 20, further comprising means for eliminating false puffs from the puff information.

23. The portable smoking topography apparatus of 20, further comprising means for computing smoking material information, and means for storing smoking material information in the memory.

24. The portable smoking topography apparatus of claim 23, further comprising means for authenticating puff information and smoking material information before the puff information and smoking material information is transferred from the memory to the workstation.

25. A portable smoking topography apparatus for providing smoking topographical information, comprising:

a smoking material holder adapted to receive a smoking material;

a smoking material detection sensor mounted on the smoking material holder and detecting presence or absence of a smoking material;

a puff sensor detecting a puff of the smoking material by a subject;

a clock;

a computing unit coupled to smoking material sensor and the puff sensor, wherein the computing unit reads start time and end time of each puff from clock, reads sample flow rates of smoke from the smoking material during each puff, reads time of insertion of smoking material and time of removal of smoking material from clock as detected by smoking material detection sensor, calculates puff information.

26. The portable smoking topography apparatus for providing smoking topographical information as in claim 25, wherein the computing unit calculates smoking material information.

27. The portable smoking topography apparatus for providing smoking topographical information as in claim 26, wherein the portable smoking topography apparatus transfers at least one of puff information and smoking material information to a workstation.

28. The portable smoking topography apparatus for providing smoking topographical information of claim 27, wherein at least one of puff information and smoking material information is displayed on a display unit coupled to the workstation.

29. The portable smoking topography apparatus for providing smoking topographical information of claim 25, wherein the portable smoking topography apparatus transfers puff information to the workstation.

30. The portable smoking topography apparatus for providing smoking topographical information of claim 29, wherein the workstation has a display unit and the puff information is displayed on the display unit.

31. The portable smoking topography apparatus for providing smoking topographical information of claim 25, wherein the computing unit eliminates false puffs.

32. The portable smoking topography apparatus for providing smoking topographical information of claim 31, wherein the portable smoking topography apparatus transfers puff information to the workstation.

33. The portable smoking topography apparatus for providing smoking topographical information of claim 32, wherein the workstation has a display unit and the puff information is displayed on the display unit.

* * * * *